United States Patent [19]

Williams

[11] 4,359,173

[45] Nov. 16, 1982

[54] TUBE HOLDER-DISPENSER

[76] Inventor: Shelley R. Williams, 500 Cheyenne Blvd. #166, Madison, Tenn. 37115

[21] Appl. No.: 184,297

[22] Filed: Sep. 5, 1980

[51] Int. Cl.[3] ..... B65D 35/28; B65D 35/56

[52] U.S. Cl. ..... 222/100; 222/106

[58] Field of Search ..... 222/100, 99, 98, 97, 222/105; 242/74, 55.2

[56] References Cited

U.S. PATENT DOCUMENTS

| | | | |
|---|---|---|---|
| 1,912,944 | 6/1933 | Lee | 222/100 |
| 2,583,631 | 1/1952 | Chenak | 222/100 |
| 2,664,225 | 12/1953 | Chokae | 222/100 |
| 3,173,578 | 3/1965 | Williams | 222/100 |
| 3,204,824 | 9/1965 | McGraw | 222/100 |
| 3,219,238 | 11/1965 | Borkenhagen et al. | 222/100 |
| 3,954,205 | 5/1976 | Williams | 222/100 |

*Primary Examiner*—Joseph J. Rolla
*Assistant Examiner*—Patricia Ray
*Attorney, Agent, or Firm*—John W. Huckert

[57] ABSTRACT

A wall mounted tube holder-dispenser having a horizontal surface to accommodate a glass and toothbrushes, and side flanges extending below the horizontal surface. A forward narrowed extension of the horizontal surface is transversely slit to provide for tube compressing, and the side flanges in this narrowed portion extend above as well as below the horizontal surface. Arcuate recesses are provided in the uppermost portion of these side flanges to snugly receive a winding reel in substantial alignment with the aforementioned transverse compressing slit but spaced above it. The winding reel has knobs at each end which extend beyond the side flanges, a threading slot coextensive with the aforementioned transverse compressing slit, and a small central viewing slot continuous with the threading slot. The closed end of the tube is fed from beneath the horizontal surface through the aligned compressing slit into the threading slot, the reel is turned catching the tube end within the threading slot, and drawing the tube upwardly through the compressing slit to discharge its contents. The reel is rotated in a clockwise direction winding the flattened portion of the tube around it until it is empty. An elongated arcuate shield member is pivotally mounted on the reel, between the side flanges and the knobs, to conceal and protect the depending tube, glass and brushes, and it is swung out of the way when the dispenser is in use.

9 Claims, 7 Drawing Figures

TUBE HOLDER-DISPENSER

BACKGROUND OF THE INVENTION

1. Field of the Invention

This invention relates generally to toothpaste tube holders and dispensers adapted to be wall mounted and which make provision for storing toothbrushes and a bathroom glass.

2. Description of the Prior Art

The present toothpaste tube holder and dispenser is an improvement upon the applicant's prior Patent Nos. 3,173,578and 3,954,205. The latter patent discloses a holder-dispenser made of deformable material adapted to be bent along fold lines. The present holder, exclusive of the winding reel, may be molded in one piece of a rigid plastic material. This makes it simpler and more economical to manufacture, easier to clean and maintain, as well as resulting in an appearance that is in harmony with the cleanly molded lines and colors of modern bathroom fixtures.

The winding reel of the present device is a superior mechanism which allows for the removal of the empty collapsed tube from the holder-dispenser by merely yanking the neck of the tube downwardly until it is freed.

SUMMARY OF THE INVENTION

The tube holder-dispenser of the present device is comprised of only two parts—the holder base and the winding reel. Each preferably are molded in one piece. The simplicity of the device makes it easy to produce and to operate. The tube threads smoothly into the holder-dispenser and is readily removed when empty.

One of the objectives of the present device is to make a tube holder-dispenser in such a manner that the threading of the tube into the dispenser and the operation of the dispenser may take place while the user is in upright position. It is entirely unnecessary for the user to stoop, bend, or twist his head during these procedures. Moveover, the removal of the empty tube can be effectuated while the user is in upright position merely by yanking downwardly upon the neck of the tube until it is freed.

It is to be noted that this dispenser is more efficient in retrieving a greater amount of material from the tube than can be expressed by hand pressure. In this regard, people and particularly people who have limited manual pressure, such as arthritics will find that the turning of the winding reel knob is far simpler and more effective than hand pressure. For such people and others who do not use toothpaste, the present dispenser may optionally be used with tubes containing gels, ointments, medicaments, and even hand creams.

The cover shield member has been designed to conceal the tube as well as the brushes and glass from view, making the device more attractive.

These together with other objects and advantages which will become subsequently apparent reside in th details of construction and operation as more fully hereinafter described and claimed, reference being had to the accompanying drawings forming a part hereof, wherein like numerals refer to like parts throughout.

DETAILED DESCRIPTION OF THE INVENTION

Figure 2:
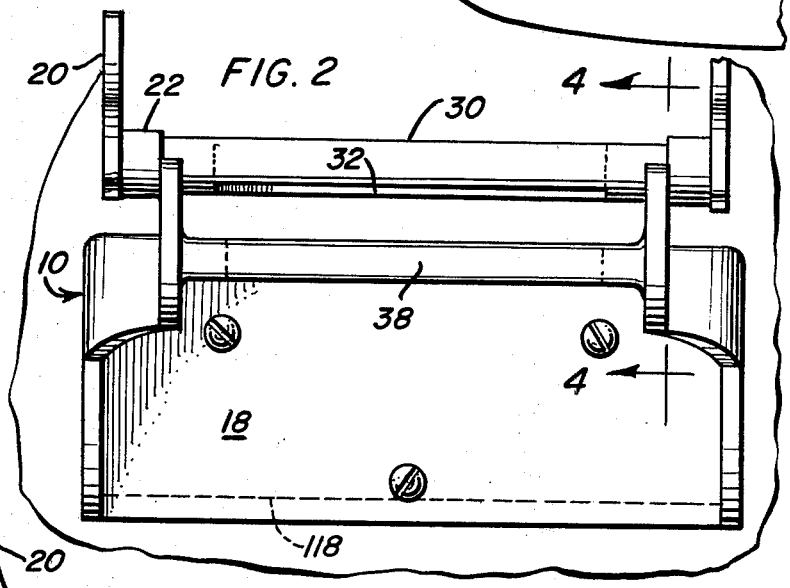
FIG. 2 is a front elevational view of the holder-dispenser.
Figure 3:
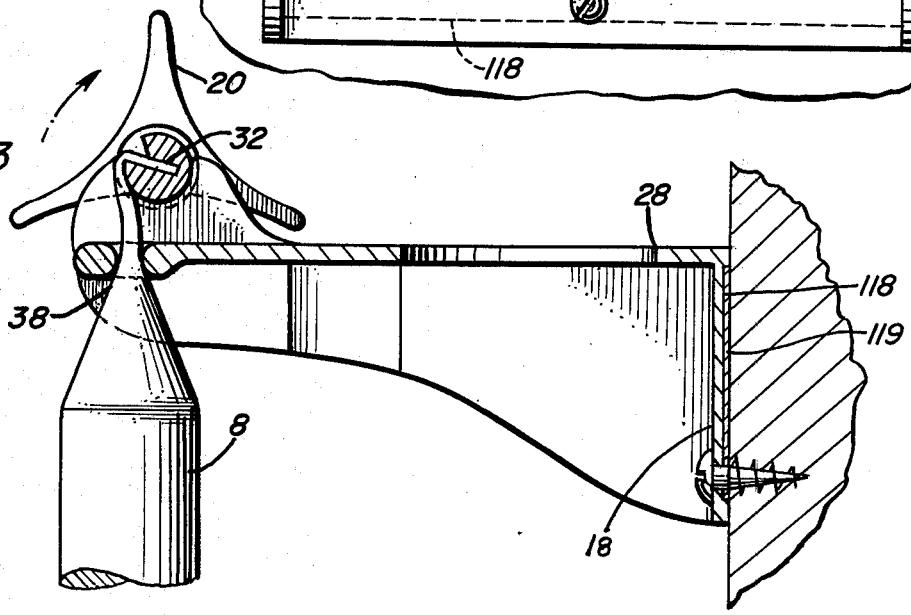
FIG. 3 is a vertical sectional view taken on line 3—3 of FIG. 1.

Referring more specifically to the drawings, numeral 10 is used to generally designate the holder-dispenser, while numeral 12 represents the horizontal component or base of the holder. The holder-dispenser 10 has accommodations 26, 28 in the horizontal base 12 for toothbrushes and a glass respectively. Side flanges 14 extend from the horizontal base to strengthen the structure, and a back wall 18 is adapted to be mounted on a wall (see FIGS. 2 and 3 of the drawings). Forwardly of the brush and glass accommodations the horizontal base narrows as at 40, and it is in this area that the side flanges extend above the horizontal surface of the base, as well as below. Arcuate recesses 16 are formed in the upper surface of the side flanges 14 in this forward area to receive a winding reel 15. The reel must fit snugly into this housing in order to prevent recoil after it has been turned during use, and to prevent disengagement unless removed for cleaning.

A transverse compression slit 38 in the forward, narrowed portion 40 of the horizontal base is formed by spaced opposing rounded edges 39 in the same plane as the horizontal base. The opposing rounded edges 39 are closest at their midpoint and farther apart at the entrance and exit of the slit 38. This narrowed space between the rounded edges 39 acts as a compressing means when the tube 8 is pulled through.

Figure 1:
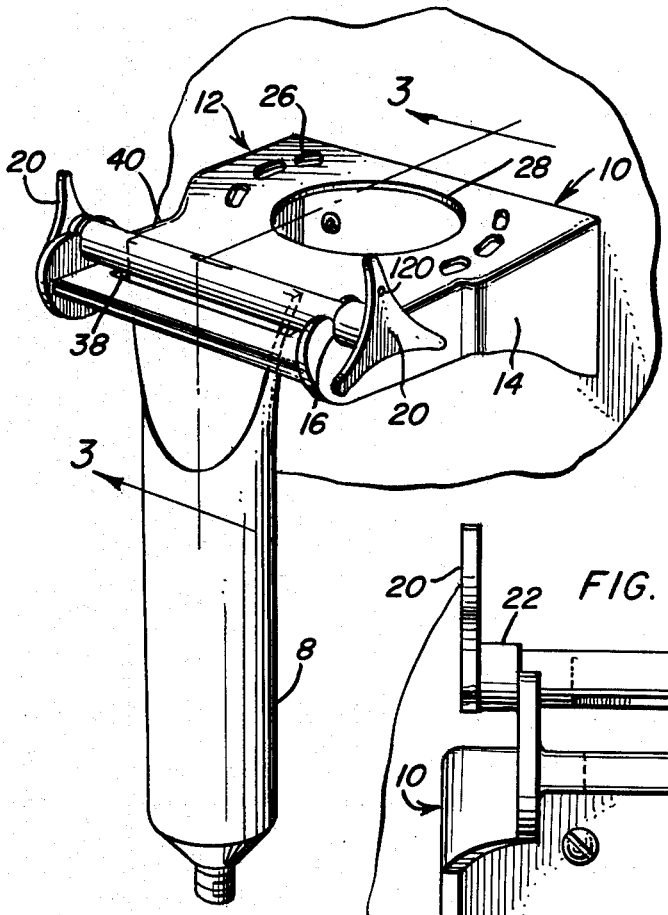
FIG. 1 is a perspective view of the holder-dispenser with a tube depending therefrom.
Figure 4:
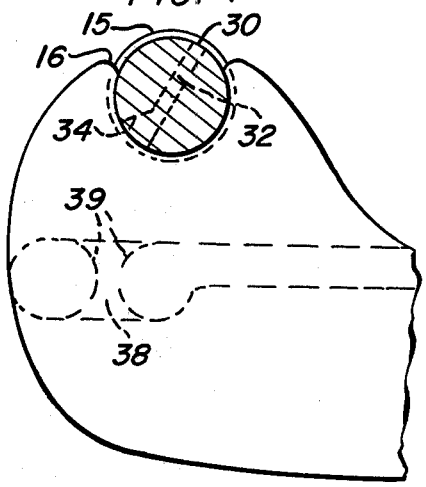
FIG. 4 is an enlarged sectional view taken on line 4—4 of FIG. 2.
Figure 5:
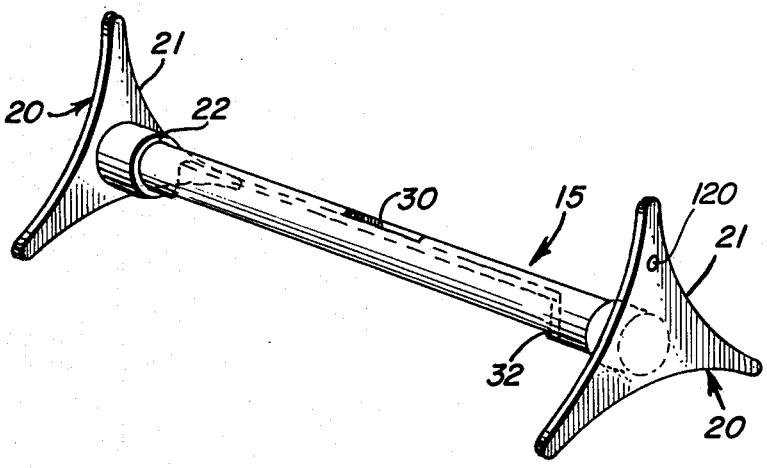
FIG. 5 is a perspective view of the winding reel.

The mechanism for pulling the tube through compression slit 38 is the winding reel 15. A knob 20 is provided at each end of reel 15 as well as a sleeve 22 and may be operated by either hand. The knob has finger indentations 21 to provide a better grasp for turning the reel (see FIG. 5). The reel extends parallel to slit 38 and seats in the arcuate recesses 16, with knobs 20 and sleeves 22 extending beyond flanges 14 in the forward area 40 of the base 12 (see FIG. 6). The threading slot 32, as shown in FIG. 5 extends nearly the full length of the reel and is cut into the reel from one peripheral surface toward its diametrically opposite peripheral surface but short of it (see FIG. 3). A central viewing slot 30 is cut into the diametrically opposite surface of the reel and is continuous with the transverse threading slot 32 midway along the reel for a distance of about ½ inch. The viewing slot 30 serves as a visual aid in threading the tube into the dispenser. When viewing slot 30 is uppermost, the threading slot 32 and the compression slit 38 are in threading position. The threading slot 32 is chamfered as at 34 (FIG. 4) to provide easy access for the tube into the reel from the front, as well as simple engress when the tube needs to be removed. Spot 120 is another tube threading visual aid.

The reel 15 is spaced above the compression slit 38, and in operation when reel 15 is rotated so that viewing slot 30 is uppermost, the broad closed end of the tube 8 may be presented from beneath slit 38 upwardly and then into the full depth of the slot 32. Then the knob 20 is turned in a clockwise direction until the closed broad end of the tube 8 is caught in the reel. As the reel turns the tube is pulled through compression slit 38 dispensing its contents and winding around the reel.

Figure 7:
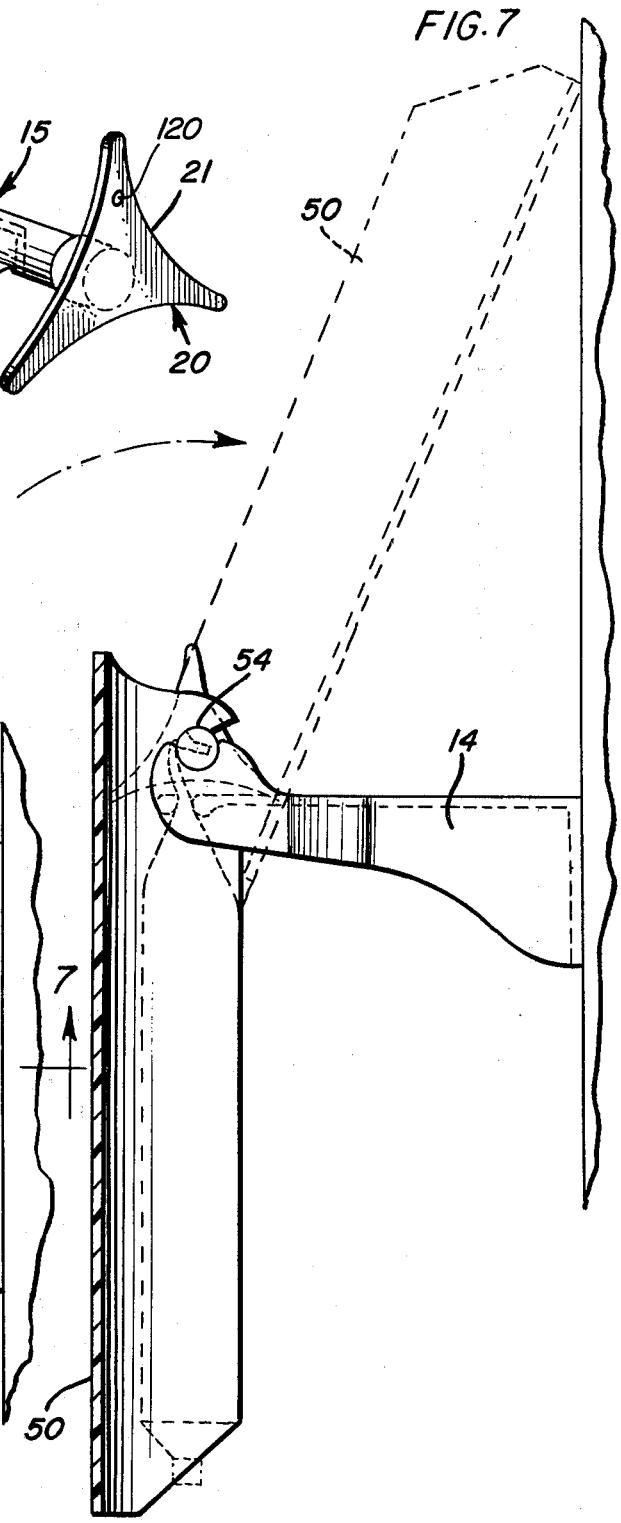
FIG. 7 is a vertical sectional view taken on line 7—7 of FIG. 6 showing the shield member in two positions.
Figure 6:
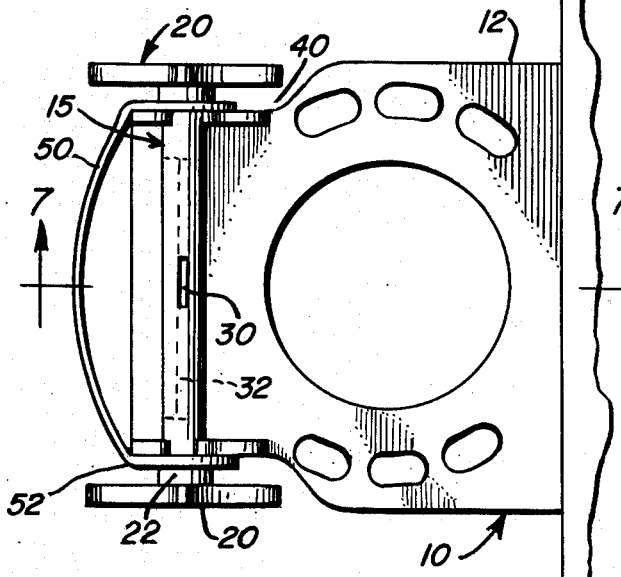
FIG. 6 is a top plan view of the holder-dispenser with a shield member mounted thereon.

An arcuate shield 50 has been provided which is of a length greater than the distance between the top of the reel and the neck of the depending tube. The forward portion of the shield 50 is bowed and the side edges 52 are flat as shown in FIG. 6, and have a notch 54 adapted to fit on the reel 15 between the knobs 20 and the side flanges 14. The shield 50 may be pivoted upwardly, as shown in FIG. 7, to expose the tube 8 when the dispenser is to be used. The shield protects the tube from splattering, and from accidental pressure, as well as adding to the appearance of the tube holder-dispenser.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is a follows:

1. A tube holder-dispenser for suspending a tube and discharging its contents comprising a horizontal base, supporting flanges at each side extending above the surface in the forward portion of the base, arcuate recesses in the upper surface of said flanges, a transverse slit in the forward portion of the base for compressing a tube, a reel for winding said tube and pulling it through the compression slit, said reel being seated in the aforesaid arcuate recesses parallel to and spaced above the compression slit, said reel having a slot extending substantially the length of the reel for anchoring the broad end of the tube, said slot being deeply cut diametrically into the reel from one peripheral surface short of the other, and a second shorter slot midlength of the reel and continuous with the first slot extending diametrically to the opposite peripheral surface for viewing the threading of the tube, a shield for protecting and concealing the tube being depended from said reel, said shield having a bowed forward portion and side end pieces notched near their top for pivoting on the reel from a downward depending position to an above the reel out of the way position when the tube is being compressed.

2. A tube holder-dispenser as defined in claim 1 wherein the first named slot in the reel is chamfered at its forward edge to facilitate the entrance and exit of the tube.

3. A tube holder-dispenser as defined in claim 1 wherein said reel has a knob at each end which knob extends beyond the side flanges.

4. A tube holder-dispenser as defined in claim 3 wherein said knobs have adjacent thereto sleeve members and have finger indentations for ease in turning, the entire reel structure being of one piece construction.

5. A tube holder-dispenser as defined in claim 1 wherein the base is molded in one piece of plastic and said slit in the base is formed by narrowly spaced opposing rounded edges.

6. A tube holder-dispenser as defined in claim 1 wherein the said base is provided with wall mounting means.

7. A tube holder-dispenser as defined in claim 1 wherein the portion of the base rearward of the reel has accommodations for toothbrushes and a glass.

8. A tube holder-dispenser as defined in claim 3 wherein a small marker circle is provided on at least one knob in alignment with said second slot as visual aid to proper threading of the tube.

9. A tube holder-dispenser as defined in claim 6 wherein said wall mounting means includes self-sticking tape provided in a recessed portion in a back wall of said base.

* * * * *